United States Patent [19]

Tamagawa et al.

[11] Patent Number: 4,800,192

[45] Date of Patent: Jan. 24, 1989

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Kanagawa, Japan

[21] Appl. No.: 28,431

[22] Filed: Mar. 20, 1987

[30] Foreign Application Priority Data

Mar. 20, 1986 [JP] Japan ..... 61-62736

[51] Int. Cl.[4] ..... B41M 5/18

[52] U.S. Cl. ..... 503/200; 427/150; 427/151; 428/211; 428/537.5; 428/913; 503/207; 503/214; 503/226

[58] Field of Search ..... 427/150–152; 503/200, 207, 214, 226

[56] References Cited

U.S. PATENT DOCUMENTS 4,289,332 9/1981 Kato ..... 427/150
4,408,781 10/1983 Watanabe ..... 427/150
4,490,732 12/1984 Maekawa et al. ..... 503/200
4,682,191 7/1987 Tamagawa et al. ..... 503/207

FOREIGN PATENT DOCUMENTS 0009823 1/1980 Japan ..... 503/200
0002794 1/1982 Japan ..... 503/200
0187891 10/1984 Japan ..... 503/200

*Primary Examiner*—Bruce H. Hess
*Attorney, Agent, or Firm*—Sughrue, Mion, Zinn, Macpeak & Seas

[57] ABSTRACT

A heat-sensitive recording paper is disclosed. The paper comprises a paper support having provided thereon a heat-sensitive color-forming layer wherein said paper support has at least 10 wt % of a white pigment contained in its interior and which also contains a polymer latex with an MFT (minimum film-forming temperature) of no higher than 40° C. in an amount of from 5 to 30 wt % based on the weight of the white pigment.

14 Claims, No Drawings

HEAT-SENSITIVE RECORDING PAPER

FIELD OF THE INVENTION

The present invention relates to a heat-sensitive recording paper which is used to record, for example, with a thermal head or a heat pen. More particularly, it is concerned with a heat-sensitive recording paper that is free from the problem of a heat-sensitive color-forming layer sticking to the thermal head and piling on the thermal head, and which permits good dot reproduction to provide recording images having high sharpness and high density even in high speed recording.

BACKGROUND OF THE INVENTION

Recent advances in facsimile devices, including printers therefor, have been remarkable. In these devices, a heat-sensitive recording system is widely used that utilizes a combination of a thermal head and a heat-sensitive recording paper having a coating of a colorless dye such as crystal violet lactone and a phenol compound, as described, for example, in Japanese Patent Publication No. 14039/70 (corresponding to U.S. Pat. No. 3,539,375).

The heat-sensitive recording system has many advantages. For example, since the recording paper is of the primary color formation type, a conventional development step is not needed, and the recording unit can be relatively simple. Therefore, the production costs for the recording paper and recording unit are low. Also, heat-sensitive recording is of the non-impact type and is not noisy. Thus, heat-sensitive recording has gained a position as a low speed recording system.

However, a major disadvantage of the heat-sensitive recording system is that it is low in recording speed compared with other recording systems, such as electrostatic recording. For this reason, the heat-sensitive recording system has not yet been successfully employed in circumstances where very high speed recording is required.

The main reason for which high speed recording cannot be attained by the heat-sensitive recording system is that heat conduction cannot be achieved sufficiently quickly between the thermal head and the heat-sensitive recording paper coming into contact with the thermal head, and, thus, sufficient recording density cannot be obtained if high speed recording is attempted. The thermal head, comprising electric resistor heat generators combined together in a dot matrix form, generates heat upon receipt of a recording signal and melts a heat-sensitive color-forming layer in contact with the thermal head, thereby allowing it to form color. In order to attain recording image of high sharpness and high density, it is necessary that dot reproduction be good. That is, it is necessary that the thermal head and the heat-sensitive color-forming layer come into as close contact as possible and heat conduction be carried out with high efficiency so that a fully colored dot conforming to the shape of the dot heat generator of the thermal head will be formed in the heat-sensitive color-forming layer in a manner completely correspondent to a high speed recording signal. In fact, however, only several percent of the amount of heat generated from the thermal head is conducted to the heat-sensitive color-forming layer and the efficiency of heat conduction is extremely low. Several methods have been proposed to increase the smoothness of the heat-sensitive color-forming layer so that the thermal head and the heat-sensitive color-forming layer will come into as close contact as possible with each other.

Japanese Patent Publication No. 20142/77 described a method in which the surface of the heat-sensitive color-forming layer is treated so that the surface smoothness as represented in terms of Bekk smoothness is from 200 to 1,000 seconds. Japanese Patent Application (OPI) No. 115255/79 (the term "OPI" as used herein refers to a "published unexamined Japanese patent application") describes that when the Bekk smoothness is from 200 to 1,000 seconds, the heat-sensitive color-forming layer can respond only to heat impulses of from about 5 to 6 milliseconds, and that for high-speed recording using heat impulses of less than 1 millisecond it is necessary for the surface of the heat-sensitive color-forming layer to be made smooth to such an extent that the Bekk smoothness is more than 1,100 seconds. However, when the Bekk smoothness is increased to more than 1,100 seconds, color fog is produced upon application of pressure. The formation of color fog is prevented by using a base paper which has been previously made smooth to an extent that the Bekk smoothness is more than 500 seconds. Japanese Patent Application (OPI) No. 156086/78 describes that the surface roughness, Ra, of the heat-sensitive color-forming layer is made to be less than 1.2 μm, and the gloss to less than 25%.

In all of the above-described prior art techniques, the smoothness of the heat-sensitive color-forming layer is increased solely by calendering operations such as super-calendering, machine calendering, and gloss calendering. This calendering operation is applied to the base paper alone, or to the base paper and the heat-sensitive paper, or to the heat-sensitive paper alone. In the heat-sensitive recording paper, however, as its smoothness is increased by calendering in order to provide an increased recording density, the chance of sticking or piling occurring is increased. In practical use, therefore, the smoothness of recording paper is suppressed to a suitable level so that the recording density and the occurrence of sticking or piling are properly balanced. In the prior art techniques, whichever level of smoothness is selected, the resulting heat-sensitive recording paper has been unsuitable for practical use for high-speed recording with respect to recording density and recording stability.

The term "sticking" as used herein refers to a phenomenon wherein the thermal head adheres to the heat-sensitive color-forming layer, thereby producing stripping noise and lowering the dot reproduction. The term "piling" refers to a phenomenon wherein heat-melted products of the heat-sensitive color-forming layer accumulate on the thermal head, thereby lowering the recording density and dot reproduction. Both of these phenomena will inhibit stable recording.

Another disadvantage as encountered in applying the calender treatment to the heat-sensitive recording paper is that color fog is formed by pressure, resulting in an increase in the density of the background of the recording paper. Similarly, in the calendering of the base paper, so-called cockle, wrinkles, etc., due to unevenness in basis weight will develop. Thus, the calendering operation is limited in its practical use. As described above, the attempt to increase the smoothness of the heat-sensitive color-forming layer by calendering so as to increase the recording density has met with only limited success, and the resulting heat-sensitive recording paper is not sufficiently satisfactory for use in high-speed recording.

Furthermore, heat-sensitive recording paper is usually used in a roll form in which it is wound on a paper tube several inches in diameter, and curling is liable to occur on the roll as a result of prolonged use. It has long been desired to overcome this curling problem.

SUMMARY OF THE INVENTION

The present invention is intended to overcome the above-described problems, and an object of the present invention is to provide a heat-sensitive recording paper which produces a high recording density and experiences reduced curling when stored in a roll form in which it is wound on a small paper tube.

As a result of concerted efforts made to eliminate the aforementioned problems the present inventors have found that an excellent product which is capable of attaining high recording density without experiencing excessive curl can be obtained by a heat-sensitive recording paper comprising a paper support having provided thereon a heat-sensitive color-forming layer wherein said paper support has at least 10 wt % of a white pigment contained in its interior and which also contains a polymer latex with an MFT (minimum film-forming temperature) of no higher than 40° C. in an amount of from 5 to 30 wt % of the white pigment.

DETAILED DESCRIPTION OF THE INVENTION

A variety of white pigments may be contained in the interior of the paper support used in the present invention and they include: inorganic pigments such as talc, clay, kaolin, calcined kaolin, diatomaceous earth, aluminum hydroxide, titanium oxide, native silica, synthetic silica, magnesium hydroxide, magnesium carbonate, calcium carbonate and barium sulfate; and organic pigments such as urea-formaldehyde resin, polystyrene resin, polyethylene resin and acrylic resin. It is desirable to use white pigments that have a whiteness of at least 75% according to the measurement described in JIS P8138 and a volume average particle diameter of from 0.1 to 10 μm. The oil absorbency of white pigments is preferably no more than 150 cc/100 g, in order to minimize the decrease in density which would occur in thermal recording with high energy. The white pigments must be contained in the paper in amounts of at least 10 wt %, preferably at least 15 wt %. The more the pigment that is used, the more effective it is for attaining the objects of the present invention. However, if the pigment is used independently and in a large amount, the sizability and strength of the paper produced will be decreased to render it unsuitable for use in the subsequent step of applying a heat-sensitive coating solution, for several reasons, such as the breakage of paper. In order to avoid this problem, the present inventors reviewed the use of a variety of strength additives in combination with the white pigment; as a result, it was found that the undesired phenomena caused by the use of the white pigment could be eliminated by incorporating a polymer latex having an MTF of not higher than 40° C. in an amount of from 5 to 30 wt % of the pigment, and that surprisingly enough the combined use of the pigment and the latex proved to be very effective in attaining the purposes of the present invention. In short, the present inventors have found that by employing a paper support that has at least 10 wt %, preferably from 15 to 30 wt %, of a white pigment contained in its interior in combination with a polymer latex having an MFT of no higher than 40° C. that is present in an amount of from 5 to 30 wt % based on the pigment, significant advantages will materialize that have not been attainable by using either the pigment or the latex alone.

Specific examples of the polymer latex having an MFT of no higher than 40° C. which are suitable for use in the present invention include SBR (styrene butadiene rubber) latex, carboxyl-modified SBR latex, MBR (methylmethacrylate butadiene rubber) latex, carboxyl-modified MBR latex, NBR (acrylonitrile butadiene rubber) latex, acrylate ester emulsions, acrylate ester/-vinyl acetate emulsion, styrene/acrylate ester emulsions, emulsions of copolymers of methyl methacrylate and styrene and acrylate esters. Among these polymer latices, those which have MFTs of not higher than 30° C. are preferable. More particularly, carboxy-modified SBR latex and carboxy-modified MBR plate are preferably used. Although the polymer latex having an MFT of no higher than 40° C. might be replaced by commonly employed water-soluble strength additives such as anion-modified polyacrylamide, cation-modified polyacrylamide, starches, melamine-formaldehyde resin, and polyamide-polyamine-epichlorohydrin resin, because such additives are effective in providing higher paper strength, such additives are detrimental, rather than favorable, for attaining the purposes of the present invention, i.e., higher color density and stronger resistance to curling.

The paper support used in the present invention is made from a stock that is chiefly composed of natural pulp but which may contain small amounts of synthetic fibers, synthetic pulp or inorganic fibers. Any natural pulp is usable, and may be illustrated by softwood pulp, hardwood pulp, straw pulp, esparto pulp, and bagasse pulp. Hardwood pulp which is comprised of short fibers and which is readily provided with a high degree of smoothness or levelness is preferably used. Pulp beating may be achieved with a beater, disk refiner, conical refiner or Jordan refiner to a water freeness which is preferably within the range of from 500 to 200 cc (Canadian Standard Freeness), and more preferably from 400 to 300 cc.

In addition to the pulp, the paper stock may contain the following chemicals: sizing agents such as rosin, paraffin wax, higher aliphatic acid salts, alkenyl succinates, aliphatic acid anhydrides, styrene-maleic anhydride copolymers, alkyl ketene dimers, and epoxidized aliphatic acid amides; softening agents such as the reaction products of maleic anhydride copolymers and polyalkylene polyamines, and quaternary ammonium salts of higher aliphatic acids; and fixing agents such as aluminum sulfate, aluminum chloride, and polyamide-polyamineepichlorohydrin. Other additives such as dyes, fluorescent dyes, antistatics and defoamers may also be used as required. The addition of the sizing agent is preferably controlled such that the degree of sizing of the final paper support will not exceed 30 g/m$^2$, and will preferably lie between 20 and 10 g/m$^2$ as measured by the Cobb test described in JIS P8140.

The paper support for use in the present invention is made from a mixture of the aforementioned ingredients on a Fourdrinier paper machine or on a cylinder paper machine for attaining a basis weight of from 30 to 200 g/m$^2$. The paper is then treated by either on-machine calendering or off-machine supercalendering to be finished to a density of from 0.80 to 0.98 g/cm$^3$.

If desired, the paper support so prepared may be provided with a pigment-based under coating layer before it is used as the support of heat-sensitive recording paper.

The heat-sensitive coating solution that may be employed in the present invention is described hereinafter.

A color former and a color developer are dispersed independently in water-soluble polymer solutions, for example, by means of a ball mill. In the case of the ball mill, a dispersion of the color former or color developer in a finely divided form is prepared by using balls having different diameters in a suitable mixing ratio, and dispersing the resulting mixture over a sufficiently long period of time. It is also effective, for example, to use a model sand mill (trademark, Dyno mill).

The thus-prepared color former and color developer dispersions are mixed, and inorganic pigments, waxes, higher fatty acid amides, and metallic soaps, and, if desired, optional ingredients such as ultraviolet absorbers, antioxidants, latex binders are added thereto to prepare a desired coating solution. These additives may be added during the dispersing process.

The coating solution is coated on a support in such a manner that the amount of the color former coated is from 0.2 to 1.0 g/m$^2$.

The color former used in the present invention is not critical; color formers commonly used in pressure-sensitive and heat-sensitive recording papers, for example, can be used in the present invention. Typical examples of such color formers are shown below.

(1) Triarylmethane-based compounds 3,3-Bis(p-dimethylaminophenyl)-6-dimethylaminophthalide (crystal violet lactone), 3-(p-dimethylaminophenyl)-3-(1,2-dimethylindol-3-yl)phthalide, 3-(p-dimethylaminophenyl)-3-(2-phenylindol-3-yl)phthalide, 3,3-bis(p-ethylcarbazol-3-yl)-3-dimethylaminophthalide, and 3,3-bis(2-phenylindol-3-yl)-5-dimethylaminophthalide.

(2) Diphenylmethane-based compounds 4,4-Bisdimethylaminobenzhydrin benzyl ether, N-halophenyl leucoauramine, and N-2,4,5-trichlorophenyl leucoauramine.

(3) Xanthene-based compounds

Rhodamine B-anilinolactam, 3-diethylamine-7-dibenzylaminofluoran, 3-diethylamino-7-butylaminofluoran, 3-diethylamino-7-(2-chloroanilino)fluoran, 3-diethylamino-6-methyl-7-anilinofluoran, 3-piperidino-6-methyl-7-anilinofluoran, 3-ethyltolylamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofluor 3-diethylamino-6-chloro-7-anilinofluoran, 3-N-cyclohexyl-N-methylamino-6-methyl-7-anilinofluoran, and 3-diethylamino-7-phenylfluoran.

(4) Thiazine-based compounds

Benzoyl leucomethylene blue, and p-nitrobenzoyl leucomethylene blue. (5) Spiro-based compounds 3-Methyl-spirodinaphthopyran, 3-ethyl-spirodinaphthopyran, 3-benzyl-spirodinaphthopyran, and 3-methylnaphtho(3-methoxybenzo)spiropyran.

They can be used singly or in combination with each other. The color former is selected depending on the particular purpose of the heat-sensitive recording paper and the desired characteristics.

As color developers which are used in the present invention, phenol derivatives and aromatic carboxylic acid derivatives are preferred. Particularly, preferred are bisphenols. Typical examples of such phenol compounds are p-octylphenol, p-tert-butylphenol, p-phenylphenol, 2,2-bis(p-hydroxy)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, and 2,2-bis(4-hydroxy-3,5-dichlorophenyl)propane. Typical examples of aromatic carboxylic acid derivatives include p-hydroxybenzoic acid, propyl p-hydroxybenzoate, butyl p-hydroxybenzoate, benzyl p-hydroxybenzoate, 3,5-di-α-methylbenzylsalicylic acid, and polyvalent metal salts thereof.

In order that the color developer melts at the desired temperature and undergoes a color-forming reaction, it is preferred that the color developer be added as a eutectic mixture in combination with a heat-fusible substance having a low melting point, or in the state where such a low melting substance is fused to the surface of color developer particles.

Waxes which can be used include paraffin wax, carnauba wax, microcrystalline wax, and polyethylene wax. In addition, higher fatty acid amides such as stearic acid amide, ethylenebisstearoamide, higher fatty acid esters, etc., can be used.

Metallic soaps which can be used include polyvalent metal salts of higher fatty acids, such as zinc stearate, aluminum stearate, calcium stearate, and zinc oleate.

Inorganic pigments which can be used include kaolin, calcined kaolin, talc, agalmatolite, diatomaceous earth, calcium carbonate, aluminum hydroxide, magnesium hydroxide, magnesium carbonate, titanium oxide, and barium carbonate.

For these inorganic pigments it is preferred that the amount of oil that can be absorbed is at least 60 ml/100 g and the average particle diameter, 5 μm or less. In the case of oil-absorbing inorganic pigments, it is desirable that they be incorporated in the recording layer in a dry amount of from 5 to 50% by weight, with the range of from 10 to 40% by weight being preferred.

They are dispersed in a binder and coated. In general, water-soluble binders are used for this purpose, including polyvinyl alcohol, hydroxyethyl cellulose, hydroxypropyl cellulose, an ethylene/maleic anhydride copolymer, a styrene/maleic anhydride copolymer, an isobutylene/maleic anhydride copolymer, polyacrylic acid, starch derivatives, casein, and gelatin.

Compounds for providing water resistance (i.e., gelling agents and crosslinking agents), and hydrophobic polymer emulsions such as a styrene/butadiene rubber latex and an acrylic resin emulsion can be added for the purpose of imparting water resistance to the above binders.

The amount of the binder in the recording layer is from 10 to 30% by weight, indicated as dry weight. In addition, other auxiliary additives such as defoaming agents, fluoroescent dyes, and coloring dyes may optionally be added to the coating solution.

In the formation of the recording layer, the above coating solution can be coated by known coating techniques, such as blade coating, air-knife coating, gravure coating, roll coating, spray coating, dip coating, bar coating, and extrusion coating.

The amount of the coating solution coated on the support is not critical; it is usually from 3 to 15 g/m$^2$, indicated as dry weight, with the range of from 4 to 10 g/m$^2$ being preferred.

The heat-sensitive recording paper of the present invention which employs a paper support that has at least 10 wt % of a white pigment contained in its interior and which also contains a polymer latex having an MFT of not higher than 40° C. in an amount of from 5 to 30 wt % of the white pigment attains the following two specific advantages: first, it contacts a thermal head over an increased area so as to achieve a higher recording density and improved dot reproduction; secondly, the increased flexibility of the support reduces the chance of the heat-sensitive recording paper curling during an extended period of use.

The following examples are provided for the purpose of further illustrating the present invention but are in no sense to be taken as limiting the scope of this invention. Unless otherwise indicated, all parts, percents, ratios and the like are by weight.

EXAMPLES

A stock consisting of 80 parts of LBKP (laubholg bleached kraft pulp) and 20 parts of NBKP (nadelholg bleached kraft pulp) was beaton to a Canadian Standard Freeness of 300 cc on a disk refiner and subsequently mixed with 1.0 parts of rosin and 1.5 parts of aluminum sulfate on the basis of the weight of dry pulp. After adding a selected pigment and polymer latex in the amounts indicated in Table 1, the stock was made into sheets of raw paper having a basis weight of 60 g/m$^2$ on a Fourdrinier paper machine. The sheets were then supercalendered to a final thickness of 67 $\mu$m (see sample Nos. 1–5 in Table 1).

For comparison, sample Nos. 6–9 (also see Table 1) were prepared in the same manner as described above, except that sample No. 6 was a base paper containing a white pigment in a smaller amount than specified by the present invention and that sample Nos. 7 to 9 did not contain any of the polymer latexes specified by the present invention.

Heat-sensitive papers were made by applying a heat-sensitive coating solution to the base papers prepared in accordance with the present invention, as well as to the comparative samples.

Preparation of Heat-Sensitive coating solution 20 kg of crystal violet lactone was placed in a 300-liter ball mill together with a 10% aqueous solution of polyvinyl alcohol (degree of saponification: 98%; degree of polymerization: 500), and dispersed therein over a 24-hour period. Similarly, 20 kg of 2,2-bis(4-hydroxyphenyl)propane was placed in a 300-liter ball mill together with a 10% aqueous solution of polyvinyl alcohol, and dispersed therein over a 24-hour period. The thus-prepared dispersions were mixed in such a manner that the weight ratio of crystal violet lactone to 2,2-bis(4-hydroxyphenyl)propane was 1/5. In addition, 5 kg of finely divided calcium carbonate was added to 20 kg of the above-prepared mixture and thoroughly dispersed to prepare the desired coating solution.

Coating of the Heat-Sensitive Coating solution

The coating solution was coated on one surface of the base paper by the use of an air-knife coater in an amount of 6 g/m$^2$ on a solids basis, dried in a hot air drier maintained at 50° C., and machine-calendered.

The above-produced heat-sensitive papers were subjected to heat-sensitive recording and measured for the recording density. The heat-sensitive papers were each wound on a paper tube 2 inches in diameter and stored for 5 months at 20° C. and 60% RH (relative humidity). At the end of the period, they were evaluated for curling.

Recording and Measurement of Density

Solid coloration was performed under the following conditions: recording speed, 2 milliseconds per dot; recording density in the main scanning direction, 5 dots/mm; recording density in the sub-scanning direction, 6 dots/mm; and energy of thermal head, 50 millijoules/mm$^2$. The recording density was determined by measuring the reflection density at 610 nm.

The results are shown in Table 2.

TABLE 1

| Sample No. | Pigment type and content | Polymer latex type and content |
|---|---|---|
| | (sample of the invention) | |
| 1 | talc (oil absorbency, 45 cc/100 g) 12.1% | SBR latex (MFT, 12° C.)*1 0.8% |
| 2 | talc (oil absorbency, 45 cc/100 g) 16.5% | MBR latex (MFT, 0° C.)*2 1.0% |
| 3 | talc (oil absorbency, 45 cc/100 g) 19.3% | SBR latex (MFT, 12° C.)*1 2.1% |
| 4 | talc (oil absorbency, 60 cc/100 g) 18.2% | acrylic emulsion (MFT, 0° C.)*3 1.0% |
| 5 | talc (oil absorbency, 60 cc/100 g) 23.2% | SBR latex (MFT, 20° C.)*4 3.2% |
| | (comparative samples) | |
| 6 | talc (oil absorbency, 45 cc/100 g) 4.8% | — |
| 7 | talc (oil absorbency, 45 cc/100 g) 14.2% | — |
| 8 | talc (oil absorbency, 45 cc/100 g) 17.2% | acrylic emulsion (MFT, 70° C.)*5 2.0% |
| 9 | talc (oil absorbency, 45 cc/100 g) 12.3% | water-soluble polyacrylamide*6 1.5% |

Note:
*1SN-304 of Sumitomo Naugatuck Co., Ltd.
*2Luxter M-960 of Dainippon Ink & Chemicals, Inc.
*3Polysol P-503 of Showa Highpolymer Co., Ltd.
*4SN-313 of Sumitomo Naugatuck Co., Ltd.
*5Voncoat SFC of Dainippon Ink & Chemicals, Inc.
*6ST-13 of Hamano Industry K.K.

TABLE 2

| Sample No. | Record density | Dot reproduction | Curl* |
|---|---|---|---|
| | (samples of the invention) | | |
| 1 | 1.01 | good | 18 |
| 2 | 1.04 | excellent | 15 |
| 3 | 1.13 | excellent | 12 |
| 4 | 1.08 | excellent | 15 |
| 5 | 1.14 | excellent | 9 |
| | (Comparative samples) | | |
| 6 | 0.78 | fair | 41 |
| 7 | 0.95 | fair | 29 |
| 8 | 0.81 | fair | 34 |
| 9 | 0.74 | poor | 39 |

*The average of elevations (mm) at the four corners of A4 size paper

As the data in Table 2 show, the samples of heat-sensitive recording paper prepared in accordance with the present invention exhibited excellent properties not only in terms of color density but also with respect to dot reproduction and anti-curl properties.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support having provided thereon a heat-sensitive color-forming layer wherein said paper support contains at least 10 wt % of a white pigment having an oil absorbency of no more than 150 cc/100 g in its interior, and also contains a polymer latex with an MFT (minimum film-forming temperature) of no higher than 40° C. in an amount of from 5 to 30 wt % based on the weight of the white pigment.

2. A heat-sensitive recording paper according to claim 1, wherein said paper support contains at least 15 wt % of said white pigment in its interior.

3. A heat-sensitive recording paper according to claim 2, wherein said white pigment has a whiteness of at least 75% and a volume average particle diameter of from 0.1 to 10 μm.

4. A heat-sensitive recording paper according to claim 1, wherein said paper support contains from 15 to 30 wt % of said white pigment in its interior.

5. A heat-sensitive recording paper according to claim 4, wherein said white pigment has a whiteness of at least 75% and a volume average particle diameter of from 0.1 to 10 μm.

6. A heat-sensitive recording paper according to claim 5, wherein said polymer latex has an MFT (Minimum Film-forming Temperature) of not higher than 30° C.

7. A heat-sensitive recording paper according to claim 4, wherein said polymer latex has an MFT (minimum form-forming temperature) of not higher than 30° C.

8. A heat-sensitive recording paper according to claim 1, wherein said white pigment has a whiteness of at least 75% and a volume average particle diameter of from 0.1 to 10 μm.

9. A heat-sensitive recording paper according to claim 8, wherein said polymer latex has an MFT (minimum film-forming temperature) of not higher than 30° C.

10. A heat-sensitive recording paper according to claim 1, wherein said polymer latex has an MFT (minimum film-forming temperature) of not higher than 30° C.

11. A heat-sensitive recording paper according to claim 10, wherein said polymer latex is carboxy-modified SBR latex or carboxy-modified MBR latex.

12. A heat-sensitive recording paper according to claim 1, wherein said white pigment is at least one inorganic pigment selected from the group consisting of talc, clay, kaolin, calcined kaolin, diatomaceous earth, aluminum, hydroxide, titanium oxide, native silica, synthetic silica, magnesium hydroxide, magnesium carbonate, calcium carbonate, and barium sulfate.

13. A heat-sensitive recording paper according to claim 1, wherein said white pigment is an organic pigment selected from the group consisting of urea-formaldehyde resin, polystyrene resin, polyethylene resin, and acrylic resin.

14. A heat-sensitive recording paper according to claim 1, wherein said polymer latex is carboxy-modified SBR latex or carboxy-modified MBR latex.

* * * * *